US009266328B2

(12) United States Patent
Hirosawa

(10) Patent No.: US 9,266,328 B2
(45) Date of Patent: Feb. 23, 2016

(54) LIQUID EJECTION HEAD AND LIQUID EJECTION APPARATUS

(71) Applicant: CANON KABUSHIKI KAISHA, Tokyo (JP)

(72) Inventor: Toshiaki Hirosawa, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/573,143

(22) Filed: Dec. 17, 2014

(65) Prior Publication Data

US 2015/0191014 A1 Jul. 9, 2015

(30) Foreign Application Priority Data

Jan. 7, 2014 (JP) ..... 2014-000954

(51) Int. Cl.
*B41J 25/316* (2006.01)
*B41J 2/14* (2006.01)
*B41J 2/21* (2006.01)

(52) U.S. Cl.
CPC ..... *B41J 2/1433* (2013.01); *B41J 2/2146* (2013.01); *B41J 25/316* (2013.01)

(58) Field of Classification Search
CPC ..... B41J 2/06; B41J 2/1433; B41J 2/04541; B41J 2002/14459; B41J 2002/14491
See application file for complete search history.

(56) References Cited

U.S. PATENT DOCUMENTS 6,257,703 B1 7/2001 Hirosawa et al.
6,659,597 B2 12/2003 Murata et al.
7,118,199 B2 * 10/2006 Mori ..... B41J 2/14072 347/58
7,533,960 B2 5/2009 Yasuda et al.
7,690,767 B2 * 4/2010 Hirosawa ..... B41J 2/14072 347/56
7,775,638 B2 * 8/2010 Hirosawa ..... B41J 2/14072 347/50
8,157,356 B2 4/2012 Yamamoto et al.

FOREIGN PATENT DOCUMENTS

JP 2003-063012 A 3/2003

* cited by examiner

*Primary Examiner* — Lamson Nguyen
(74) *Attorney, Agent, or Firm* — Fitzpatrick, Cella, Harper & Scinto

(57) ABSTRACT

Provided are a liquid ejection head and a liquid ejection apparatus which can reduce the distance between an ejection port and a medium as much as possible and can apply liquid to a desired position, even in the case where a member protruding more toward a liquid ejection direction than an ejection port is provided. A liquid ejection apparatus applies liquid to a medium by using a liquid ejection head including an ejection port ejecting the liquid and a member protruding more toward a liquid ejection direction than an ejection port face where the ejection port is formed, wherein a first distance between the ejection port and the medium is smaller than a sum of a second distance from the ejection port face to a tip of the member in the ejection direction and a third distance from the tip to the medium.

9 Claims, 11 Drawing Sheets

LIQUID EJECTION HEAD AND LIQUID EJECTION APPARATUS

BACKGROUND OF THE INVENTION

1. Field of the Invention

The present invention relates to a liquid ejection head and a liquid ejection apparatus, and in particular, relates to a liquid ejection apparatus applying liquid to a medium by ejecting liquid from an ejection port of a liquid ejection head.

2. Description of the Related Art

In a liquid ejection head having an ejection port for liquid ejection, there is known a configuration using a heating resistance element as an ejection energy generation element. Liquid ejection methods using the heating resistance element include a method of ejecting liquid parallel to a substrate surface where the heating resistance elements are arranged (edge shooter method) and a method of ejecting the liquid vertically to the substrate surface where the heating resistance elements are arranged (side shooter method).

Japanese Patent Laid-Open No. 2003-63012 discloses a liquid ejection head of the side shooter method. In this liquid ejection head, a sealing material covers and seals an electrical connection portion connecting an element substrate where an ejection port is formed and a flexible film.

Meanwhile, in the case where the distance between the ejection port and a liquid application face of the medium to which liquid is to be applied is relatively large at ejecting the liquid from the ejection port of the liquid ejection head, the application position of the liquid ejected from the ejection port is sometimes shifted from a desired position. On the other hand, in the case where this distance is relatively small, sometimes, the medium is deformed, and the ejection port or an ejection port face comes into contact with the medium, and this causes liquid which is not intended to be applied to the medium to attach the medium and causes so-called jamming such as medium clogging to occur.

In the case where the liquid ejection head disclosed in Japanese Patent Laid-Open No. 2003-63012 is mounted on a liquid ejection apparatus so that the ejection port face where the ejection port is formed becomes parallel to the liquid application face of the medium, the sealing material is put into a state of protruding more toward the liquid ejection direction than the ejection port face. In such a case, the distance between the tip of the protruding member and the medium is set to be a small distance as much as possible, that is, a distance in which the tip of the member does not come into contact with the medium even in the case where medium is deformed. Accordingly, the distance between the ejection port and the liquid application face of the medium becomes larger by a protrusion amount of the member from the ejection port face.

SUMMARY OF THE INVENTION

The present invention provides a liquid ejection head and a liquid ejection apparatus capable of making the distance between the ejection port and the medium small as much as possible and applying the liquid to a desired position, even in the case where a member which is protruding more toward the liquid ejection direction than the ejection port face is provided.

According to a first aspect of the present invention, a liquid ejection apparatus applies liquid to a medium by using a liquid ejection head including an ejection port ejecting the liquid and a member protruding more toward a liquid ejection direction than an ejection port face where the ejection port is formed, wherein a first distance between the ejection port and the medium is smaller than a sum of a second distance from the ejection port face to a tip of the member in the ejection direction and a third distance from the tip to the medium.

According to a second aspect of the present invention, a liquid ejection head includes an ejection element substrate where an ejection port ejecting liquid is formed and a support member having a support face supporting the ejection element substrate, wherein the support face is an inclined face supporting the ejection element substrate, with an inclination with respect to a liquid application face of a medium where the liquid ejected from the ejection port is applied, in a posture during use of the liquid ejection head.

According to the above configurations, it is possible to reduce the distance between the ejection port and the medium as much as possible and to apply the liquid to a desired position, even in the case where a member which is protruding more toward the liquid ejection direction than the ejection port face is provided.

Further features of the present invention will become apparent from the following description of exemplary embodiments (with reference to the attached drawings).

DESCRIPTION OF THE EMBODIMENTS

Hereinafter, embodiments of the present invention will be explained in detail with reference to the drawings.

First Embodiment

Figure 1:
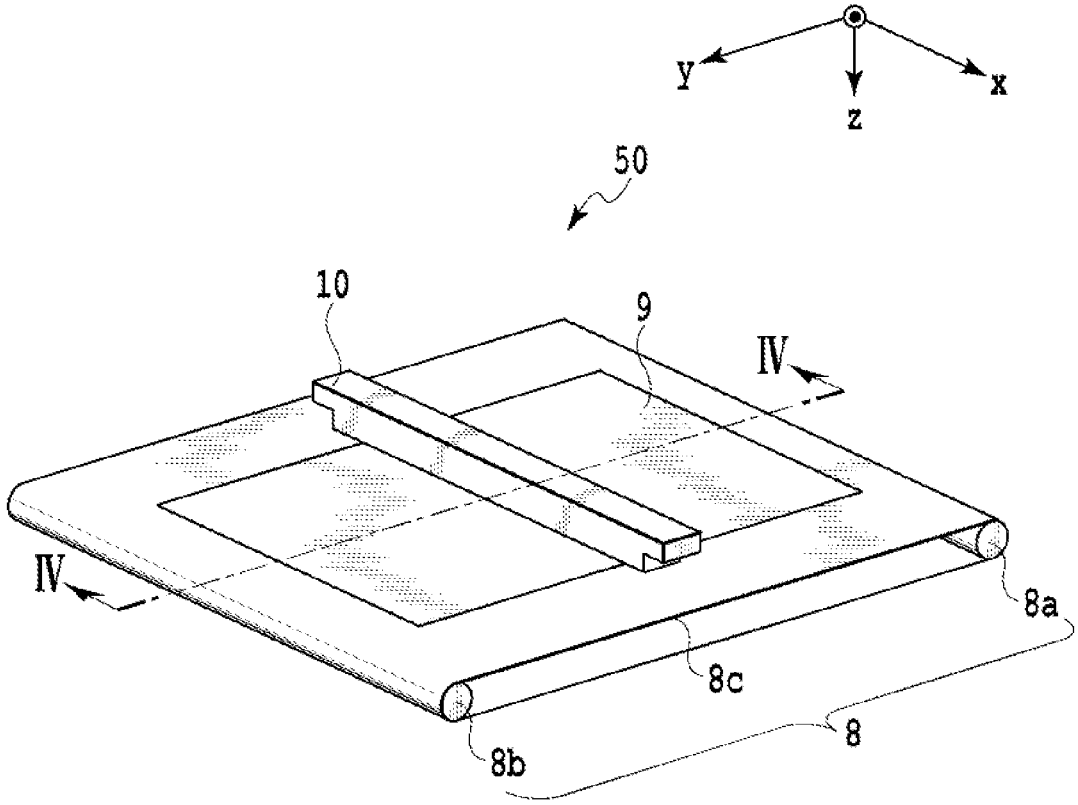
FIG. 1 is a schematic perspective view showing an internal configuration of a print apparatus in a first embodiment.

FIG. 1 is a schematic perspective view showing an internal configuration of an inkjet print apparatus (hereinafter, called "print apparatus") 50 as a liquid ejection apparatus in a first embodiment. As shown in FIG. 1, the print apparatus 50 is a line printer using a full-line type print head 10 as a liquid ejection head.

The print head 10 has an ejection port formed in a range covering the maximum width of a print medium 9 in a direction (x-direction shown in FIG. 1) intersecting with a conveyance direction of the print medium 9 (y-direction shown in FIG. 1). As an inkjet method, there can be adopted a method using a heating resistance element, a method using a piezo element, a method using an electrostatic element, a method using a MEMS element and the like. The present embodiment uses the heating resistance element. In this case, heating of the heating resistance element causes ink to foam and the ink is ejected from the ejection port through the utilization of foaming energy.

In the print apparatus 50, liquid is ejected from the ejection port of the print head 10 in the z-direction shown in FIG. 1, and a conveyance mechanism 8 conveys the print medium 9 in the y-direction and thus the print apparatus 50 prints an image on the print medium 9. While a cut paper is shown as the print medium 9 in FIG. 1, the print medium 9 may be a continuous paper or the like.

The conveyance mechanism 8 is constituted by winding a conveyance belt 8*c* around a conveyance roller 8*a* disposed on the upstream side in the y-direction and a conveyance roller 8*b* disposed on the downstream side in the y-direction. The conveyance rollers 8*a* and 8*b* are rotationally driven to thereby move the conveyance belt 8*c*, and thus the print medium 9 placed on the conveyance belt 8*c* is conveyed.

Figure 2:
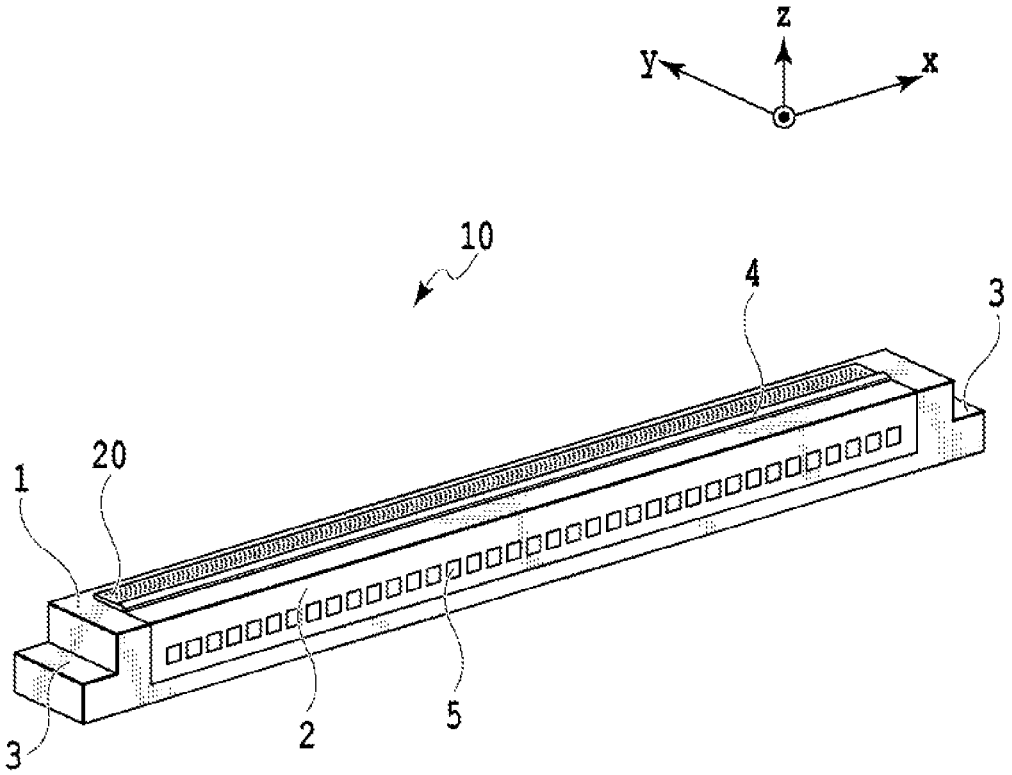
FIG. 2 is a perspective view showing a print head in a first embodiment.
Figure 3:
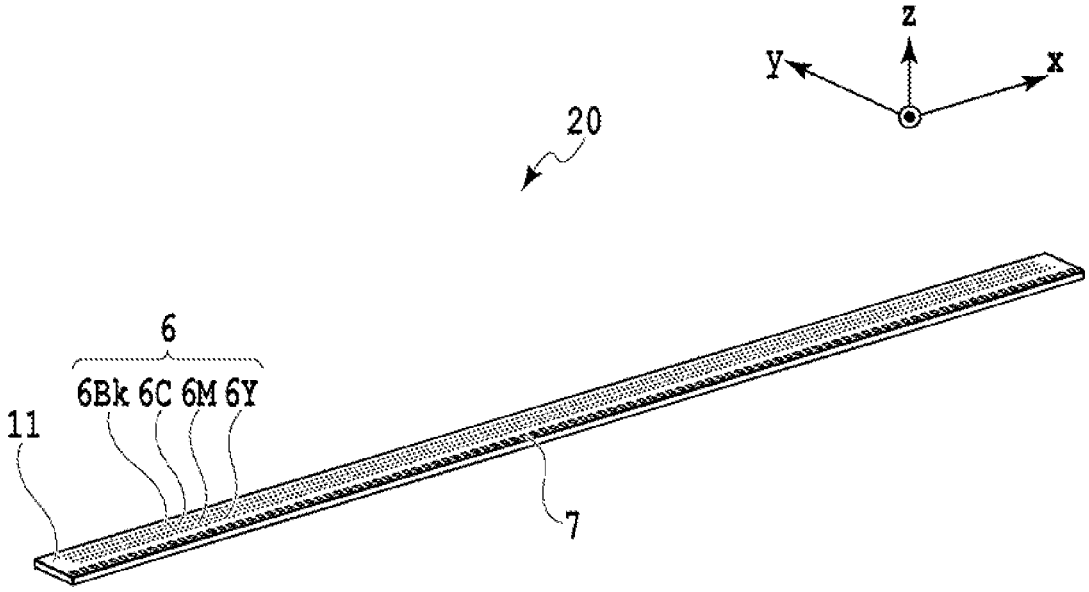
FIG. 3 is a perspective view showing an ejection element substrate in a first embodiment.

A configuration of the print head 10 will be explained by using FIG. 2 and FIG. 3. FIG. 2 is a perspective view showing the print head 10 in the present embodiment, and FIG. 3 is a perspective view showing an ejection element substrate 20 in the present embodiment. As shown in FIG. 2, the print head 10 includes a support member 1, a flexible wiring member 2 (wiring member), a sealing material 4 (sealing member), an electrical connection pad 5, and an ejection element substrate 20. A head fixing face 3 for fixing the print head 10 to the print apparatus 50 is provided at each end of the print head 10 in the x direction.

While details will be explained below with reference to FIG. 3, the print head 10 of the present embodiment has four ejection port arrays each constituted with a plurality of ejection ports, and inks different in color for each of the arrays are ejected from the ejection ports constituting each of the arrays. In the present embodiment, ink of cyan (C), ink of magenta (M), ink of yellow (Y), and ink of black (Bk) are used.

The ink having the corresponding color is supplied to the ejection ports constituting each of the ejection port arrays from an ink tank (not shown in the drawing) disposed in the print head 10. The ink of each color may be supplied from the ink tank (not shown in the drawing) via an ink tube (not shown in the drawing). In addition, the kinds of ink and the number of the ejection port arrays are not limited to these kinds and number.

As shown in FIG. 2, the ejection element substrate 20 and the flexible wiring member 2 are disposed on the support member 1. As shown in FIG. 2, the electrical connection pad 5 is formed on the flexible wiring member 2. The electrical connection pad 5 supplies a print signal and electrical power from an external device to the ejection element substrate 20.

As shown in FIG. 3, the four ejection port arrays are formed on an ejection port face 11 of the ejection element substrate 20 in the y-direction, each of the arrays being constituted by the plurality of ejection ports disposed along the x-direction. More specifically, there are formed the ejection port array 6Y constituted by the ejection ports ejecting yellow ink and the ejection port array 6M constituted by the ejection ports ejecting magenta ink. There are formed the ejection port array 6C constituted by the ejection ports ejecting cyan ink and the ejection port array 6Bk constituted by the ejection ports ejecting black ink. Here, the "ejection port array 6" is a general term used for the ejection port array 6Y, the ejection port array 6M, the ejection port array 6C, and the ejection port array 6Bk.

As shown in FIG. 3, the ejection port array 6 is disposed in the order of the ejection port arrays 6Y, 6M, 6C, and 6Bk from the upstream side to the downstream side in the y-direction.

Furthermore, a plurality of bonding terminals 7 is disposed on the ejection port face 11 of the ejection element substrate 20 along the x-direction. The ejection port array 6 and the bonding terminal 7 are formed on a Si substrate where a heating resistance element is disposed.

The bonding terminal 7 of the ejection element substrate 20 shown in FIG. 3 and bonding terminal (not shown in the drawing) of the flexible wiring member 2 shown in FIG. 2 are electrically connected to each other by a method such as wire bonding or the like. This electrical connection portion (portion including bonding wire and bonding terminal) is covered and sealed by the sealing material 4 shown in FIG. 2, to prevent corrosion or the like by adhesion of a liquid droplet ejected from the ejection port or a liquid droplet bounced back from the print medium. In the present embodiment, an epoxy resin or the like is used as the sealing material 4.

As shown in FIG. 2, since the sealing material 4 covers and seals the electrical connection portion, the sealing material 4 is put into a state of protruding in the z-direction by an amount of the thickness thereof. The print head 10 become a state shown in FIG. 4 in the case where the print head 10 having such a configuration is fixed at a position parallel to the print medium.

Figure 4:
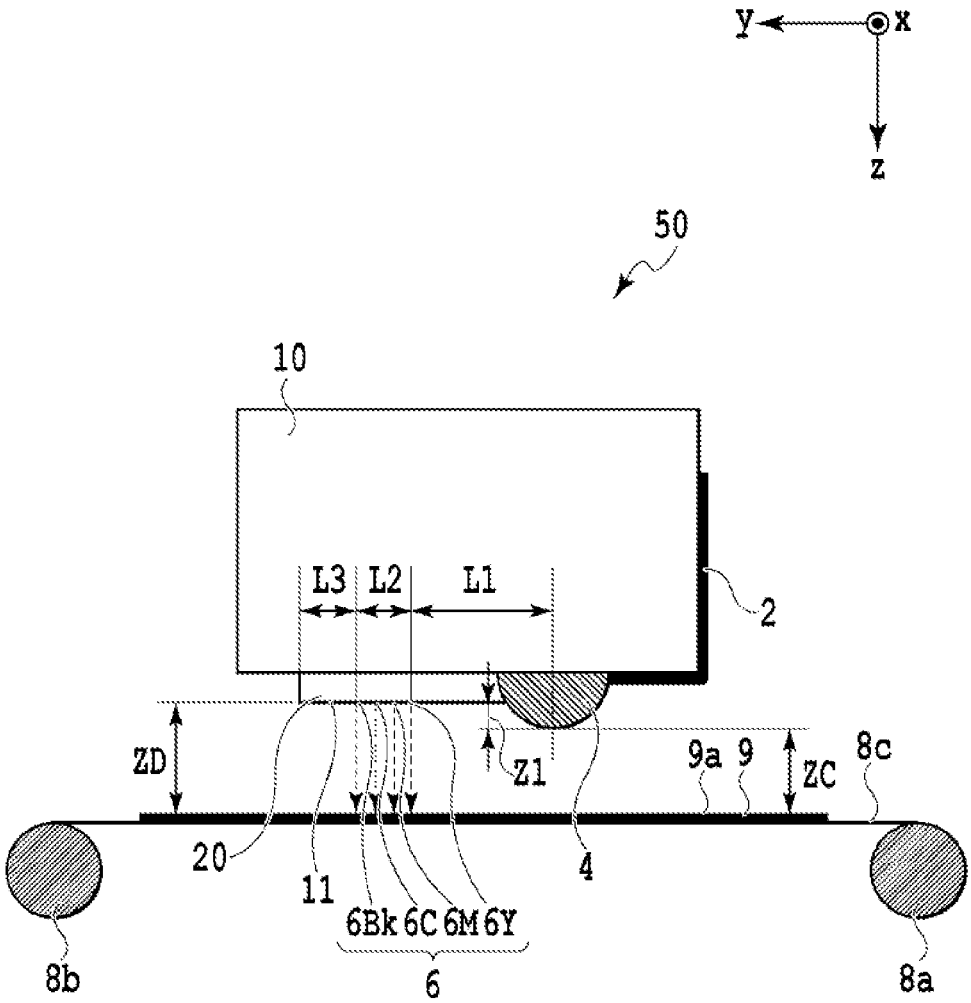
FIG. 4 is a cross-sectional view showing a mounted state of a print head.

FIG. 4 is a cross-sectional view showing a mounted state of the print head 10 on the print apparatus 50, and shows a state in which the print head 10 is fixed at the position parallel to the print medium 9. Meanwhile, FIG. 4 to FIG. 10 show cross-sections along line IV-IV shown in FIG. 1.

If the distance between the ejection port and the face of the print medium 9 to which the ink ejected from the ejection port is applied (liquid application face 9*a*) is relatively large, there may be a case where the ink is not applied to a desired position of the liquid application face 9*a* or the position onto which the ink is deposited is shifted from a predetermined position, thus resulting in degradation of image quality. However, if this distance is too small and deformation such as corrugation is caused in the print medium 9, there may be a case where the ejection port and the print medium 9 come into contact with each other and thus the ink attached to the ejection port or the ejection port face 11 attaches to the print medium 9, or the ejection port face is damaged. Accordingly, the distance between the ejection port and the liquid application face 9*a* of the print medium 9 (paper distance) is preferably set to a distance large enough to prevent the print medium from coming into contact with the ejection port face, and while at the same time, to the smallest possible distance to prevent ink printing position from being shifted.

Furthermore, in the case where the distance between the sealing material 4 and the liquid application face 9*a* of the print medium 9 is too small, there arises a situation in which the sealing material 4 and the print medium 9 come into contact with each other and clogging of the print medium 9 is caused.

The minimum distance for preventing the print medium 9 from coming into contact with the ejection port face 11 or the sealing material 4 is set to a distance ZC even in the case where the print medium 9 is displaced in the z-direction due to deformation such as corrugation, and the distance ZC is 1 mm in this configuration.

As shown in FIG. 4, in the case where the print head 10 is fixed at the position where the ejection port face 11 becomes parallel to the liquid application face 9*a* of the print medium 9, the position of the print head 10 is set using the tip of the sealing material 4 as a reference so that the tip (apex) of the sealing material 4 in the z-direction does not come into contact with the print medium 9.

As shown in FIG. 4, in the case where the print head 10 is fixed at the position where the ejection port face 11 becomes parallel to the liquid application face 9*a*, a distance ZD between the ejection port face 11 and the liquid application face 9*a* becomes larger than the distance ZC between the apex of the sealing material 4 in the z-direction and the liquid application face 9*a*. More specifically, the distance ZD is larger than the distance ZC by a distance Z1 corresponding to the length of a part where the sealing material 4 protrudes in the z-direction from the ejection port face 11.

In this way, in the case where the sealing material 4 protruding more in the z-direction than the position of the ejection port is provided on the print head 10 and the print head 10 is fixed parallel to the print medium 9, the distance between the ejection port and the print medium 9 becomes larger by an amount of the thickness of the protruding part. Accordingly, sometimes, the ink is not applied to a desired position, and the quality of an image in the case where the ejection port is located at the position of the distance ZD becomes lower than the quality of an image in the case where the ejection port is located at the position of the distance ZC.

In order to suppress this degradation of the image quality, in the present embodiment, the distance between the ejection port and the liquid application face 9*a* of the print medium 9 is made as small as possible also in the configuration in which the sealing material 4 protruding from the ejection port face 11 in the z-direction is provided. That is, the image quality degradation is suppressed by means of making the distance ZO from the ejection port to the liquid application face 9*a* smaller than the sum of the distance Z1 corresponding to the length of a part where the sealing material 4 protrudes from the ejection port face 11 and the distance ZC from the tip of the sealing material 4 to the liquid application face 9*a*.

Figure 5:
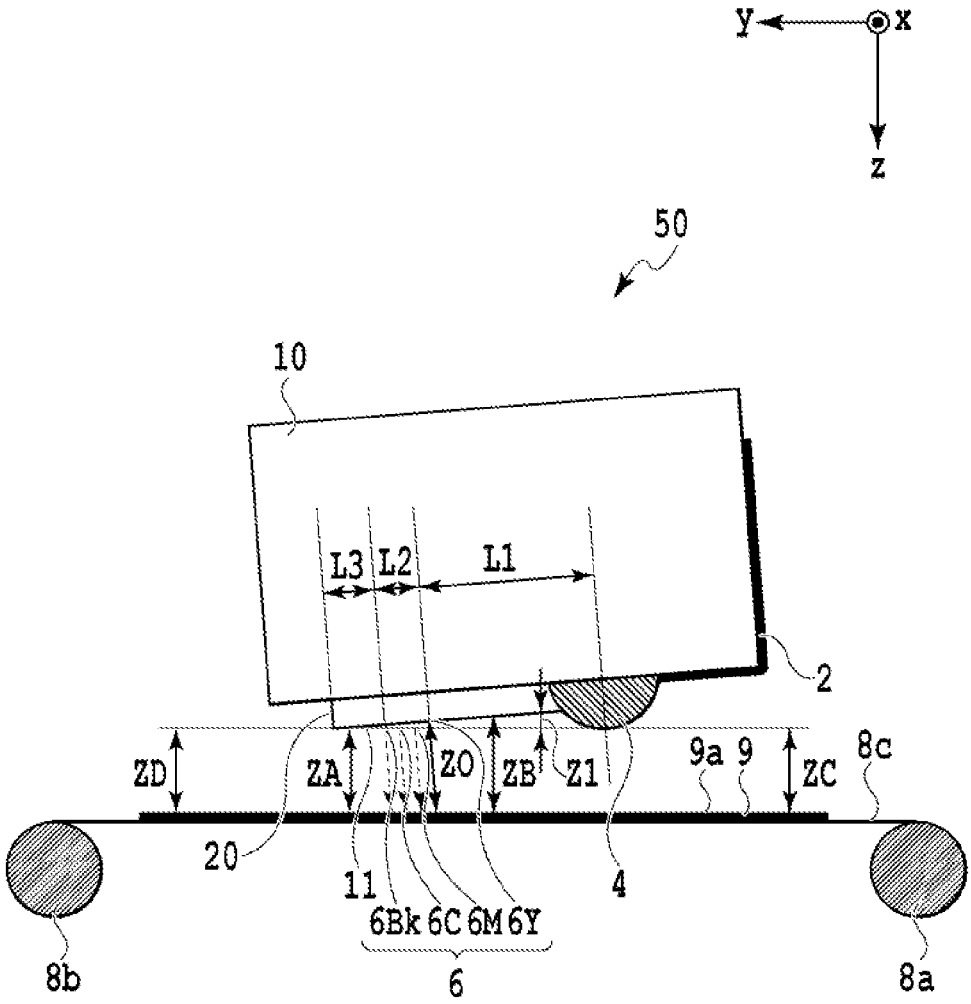
FIG. 5 is a cross-sectional view showing a mounted state of a print head in a first embodiment.
Figure 6:
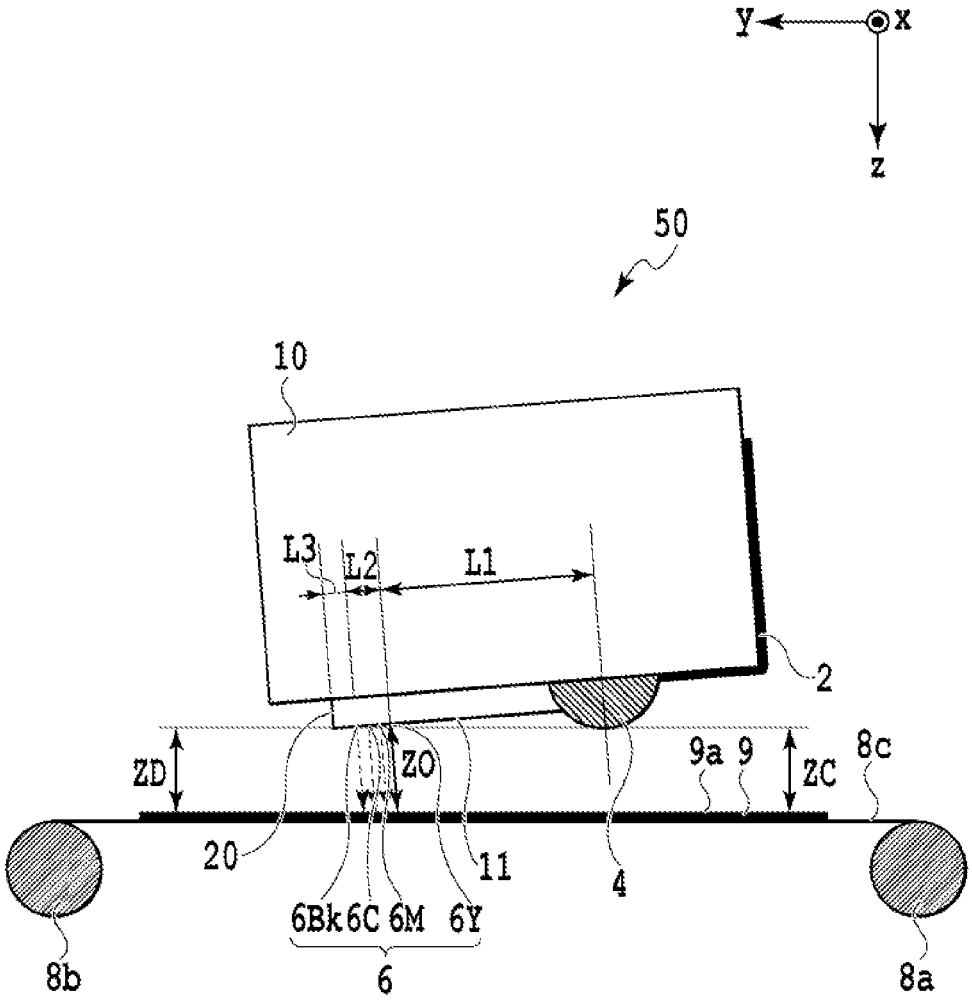
FIG. 6 is a cross-sectional view showing a mounted state of a print head in a variation example of a first embodiment.

Here, in FIG. 4 to FIG. 6, the distance in the y-direction between the ejection port array 6Y which is located nearest to the sealing material 4 in the ejection port array 6 and the tip of the sealing material 4 is set to a distance L1. Furthermore, the distance in the y-direction between the ejection port array 6Y and the ejection port array 6Bk which is located farthest from the sealing material 4 in the ejection port array 6 is set to a distance L2, and the distance between the ejection port array 6Bk and the end part of the ejection element substrate 20 on the downstream side in the y-direction is set to a distance L3.

Moreover, in the case shown in FIG. 4, it is assumed that the distance Z1 is 0.3 mm, the distance ZO is 1.3 mm, the distance L1 is 6 mm, the distance L2 is 3 mm, and the distance L3 is 3 mm.

FIG. 5 is a cross-sectional view showing a mounted state of the print head 10 on the print apparatus 50 in the present embodiment. In the present embodiment, the print head 10 is fixed to the print apparatus 50 so that the ejection port face 11 of the print head 10 has an inclination with respective to the liquid application face 9*a*. That is, the print head 10 is fixed so that a distance ZA between the ejection port face 11 relatively far from the sealing material 4 on the downstream side in the y-direction and the liquid application face 9*a* becomes smaller than a distance ZB between the ejection port face 11 relatively close to the sealing material 4 on the upstream side in the y-direction and the liquid application face 9*a*.

Meanwhile, in FIG. 5 to FIG. 9, the distance between the ejection port configuring the ejection port array 6Y and the liquid application face 9*a* is set to a distance ZO and the distance between the end part of the ejection element substrate 20 on the downstream side in the y-direction and the liquid application face 9*a* is set to the distance ZD.

In the case shown in FIG. 5, the print head 10 is fixed to the print apparatus 50 so that the distance ZC and the distance ZD are approximately equal to each other. As a result, in the configuration shown in FIG. 5, it is possible to cause the distance between the ejection port and the liquid application face 9*a* to be smaller than that in the configuration shown in FIG. 4, without causing either the tip of the sealing material 4 or the ejection port face 11 to come closer to the liquid application face 9*a* than the distance ZC.

Specifically, while the distance ZD is 1.3 mm in the case shown in FIG. 4, the distance ZO becomes 1.15 mm in the case shown in FIG. 5. In this way, in the present embodiment, by fixing the print head 10 obliquely to the print medium 9, it is possible to reduce the distance between the ejection port and the liquid application face 9*a* compared with the case of fixing the print head 10 parallel to the print medium 9.

Furthermore, also in the configuration in which the distance between the ejection port and the liquid application face 9*a* is reduced, the distance ZC is secured in the same way as in the configuration shown in FIG. 4. Thereby, it is possible to prevent the sealing material 4 or the ejection port from coming into contact with the print medium 9 while improving the image quality.

In the present embodiment, the print head 10 is fixed so that the distance ZC and the distance ZD are approximately equal to each other. From the viewpoint of attachment accuracy of the print head 10 and conveyance accuracy of the conveyance mechanism 8, it is difficult to cause the distance ZC and the distance ZD to strictly coincide with each other. However, in the case where the difference between the distance ZC and the distance ZD can be reduced to the minimum, for example, reduced to approximately 10% of the minimum distance, the influence of the difference of these distances, for example, print position shift in the case where the distance ZD is larger than the distance ZC and the difference of these distances is relatively large, can be suppressed to the minimum.

However, in the print head 10 having the plurality of ejection port arrays as in the present embodiment, since each of the ejection port arrays has are disposed at a different position in the y-direction, the distance between the ejection port and the liquid application face 9*a* is slightly different for each of the ejection port arrays.

In the case of the print head 10 which ejects different inks for each of the ejection port arrays as in the present embodiment, an ink of light color (for example, yellow, light magenta, light cyan, and the like) is ejected from the ejection port in the ejection port arrays located at a position where the distance between the ejection port and the liquid application face 9*a* is relatively large. Thereby, even in the case where the print position displacement (ejection deviation or satellite printing) is caused, it is possible to make the print position displacement inconspicuous. Meanwhile, a color having relatively high lightness when an ink is applied to the print medium is referred to as light color in the present specification.

Modification

In the print head 10 of the present modification, the ejection port array 6 is disposed at a position more apart from the sealing material 4 in the y-direction than the position shown in FIG. 5. The other configuration is the same as that of the first embodiment and explanation thereof will be omitted.

In order to suppress the difference in the distance between the ejection port and the print medium 9 for each of the ejection port arrays, there are considered a method of reducing the distance between the ejection port arrays, a method of setting the position of the whole ejection port array to the end part of the ejection element substrate without changing the distance between the ejection port arrays, and the like. In the present variation example, without changing the distance L2 of the ejection port arrays, the position of the ejection port array 6 on the ejection element substrate 20 is set to be apart from the sealing material 4 compared with the case shown in FIG. 5.

FIG. 6 is a cross-sectional view showing a mounted state of the print head 10 on the print apparatus 50 in the present modification. In the print head 10 shown in FIG. 6, the ejection port array 6 is disposed apart from the sealing material 4 as compared with the print head 10 shown in FIG. 5. That is, the distance L1 shown in FIG. 6 is larger than the distance L1 shown in FIG. 5, and the distance L3 shown in FIG. 6 is smaller than the distance L3 shown in FIG. 5.

In this way, in the present modification, the ejection port array 6 is disposed at a position apart from the sealing material 4 and also on the end part side of the ejection element substrate 20 in the y-direction. Thereby, it is possible to suppress the difference in the distance between the ejection port and the print medium 9, among the ejection port arrays, and also to reduce the distance between the ejection port for each of the ejection port arrays and the print medium 9. Furthermore, since the minimum distance ZC is secured also in the present modification in the same way as in the first embodiment, it is possible to prevent the ejection port or the ejection port face 11 from coming into contact with the print medium 9 even in the case where deformation or the like is caused in the print medium 9.

Second Embodiment

In the present embodiment, the conveyance mechanism 8 is constituted so as to be inclined with respect to the ejection port face 11 of the print head 10. Specifically, the conveyance mechanism 8 is constituted so as to be inclined with respect to the horizontal plane, and the print head 10 is fixed parallel to the horizontal plane. The other configuration is the same as that of the first embodiment and explanation thereof will be omitted.

Figure 7:
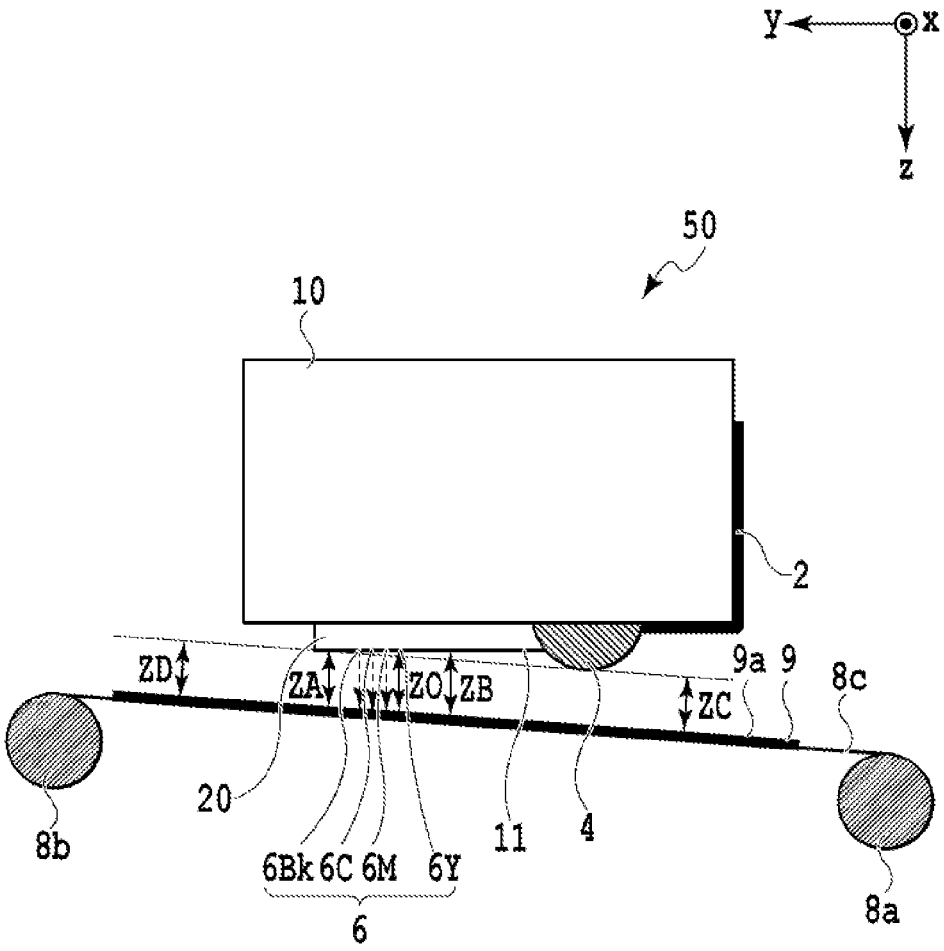
FIG. 7 is a cross-sectional view showing a mounted state of a print head in a second embodiment.

FIG. 7 is a cross-sectional view showing a mounted state of the print head 10 on the print apparatus 50 in the present embodiment. As shown in FIG. 7, in the present embodiment, the conveyance mechanism 8 is configured to be inclined with respect to the horizontal plane. More specifically, the conveyance roller 8*b* is disposed at a position closer to the print head 10 than the conveyance roller 8*a*, and thus the conveyance belt 8*c* wound around the conveyance roller 8*a* and the conveyance roller 8*b* and the ejection port face 11 of the print head 10 are relatively obliquely disposed.

Thereby, as to the distance between the liquid application face 9*a* of the print medium 9 which is placed and conveyed on the conveyance belt 8*c* and the ejection port, the distance ZA on the conveyance roller 8*b* side, that is, at a position far from the sealing material 4 is smaller than the distance ZB on the conveyance roller 8*a* side, that is, at a position close to the sealing material 4. Furthermore, the present embodiment also has a configuration in which the distance ZC and the distance ZD is approximately equal to each other.

In this way, also in the present embodiment, both of the tip of the sealing material 4 and the ejection port face 11 are not disposed at a position which is closer to the liquid application face 9*a* than the distance ZC, and the distance between the ejection port and the liquid application face 9*a* is reduced as compared with that in the configuration shown in FIG. 4. Thereby, it is possible to prevent the sealing material 4, the ejection port face 11, or the like, from coming into contact with the print medium 9 during the image printing, and also it is possible to suppress the image quality degradation.

Moreover, in the present embodiment, it is possible to suppress image quality degradation which might be caused in the case where the print head 10 is obliquely fixed to the print apparatus 50 so that the ejection port face 11 of the print head 10 has an inclination with respect to the liquid application face 9*a*. That is, it is possible to prevent the image quality degradation or the like which is caused by the fact that the ink attached to the ejection port face 11 moves along the inclined ejection port face 11 to thereby be applied to the print medium 9.

Third Embodiment

In the present embodiment, the print head 10 is fixed parallel to the horizontal plane by the use of the print head 10 in which a support face of the support member 1 is an inclined face, the support face supporting the ejection element substrate 20. The other configuration is the same as that in the first embodiment and explanation thereof will be omitted.

Figure 8:
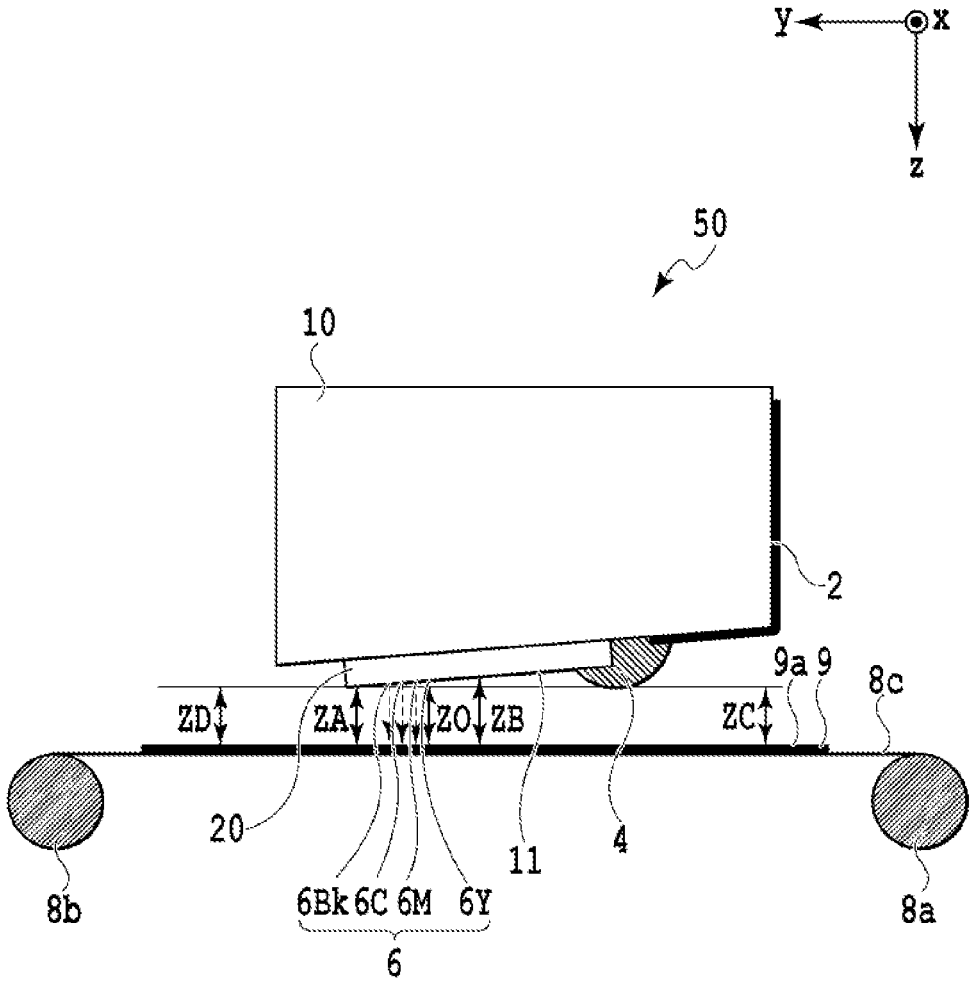
FIG. 8 is a cross-sectional view showing a mounted state of a print head in a third embodiment.

FIG. 8 is a cross-sectional view showing a mounted state of the print head 10 on the print apparatus 50 in the present embodiment. In the present embodiment, the face (support face) where the ejection element substrate 20 is disposed on the support member 1 shown in FIG. 2 is formed as a face inclined with respect to the head fixing face 3. In more detail, an inclined face is formed on the support member 1 so that the distance ZA becomes smaller than the distance ZB in the posture at the time of using the print head 10.

Thereby, as shown in FIG. 8, the distance ZA becomes smaller than the distance ZB in the case where the print head 10 is mounted on the print apparatus 50. Furthermore, the present embodiment also has the configuration in which the distance ZC and the distance ZD are approximately equal to each other.

In this way, also in the present embodiment, both of the tip of the sealing material 4 and the ejection port face 11 are not disposed at a position which is closer to the liquid application face 9*a* than the distance ZC, and the distance between the ejection port and the liquid application face 9*a* is reduced as compared with that in the configuration shown in FIG. 4. Thereby, also in the present embodiment, it is possible to prevent the sealing material 4 or the ejection port face 11 from coming into contact with the print medium 9 during the image printing, and also it is possible to suppress the image quality degradation.

Meanwhile, here, although there has been explained a configuration in which the distance between the ejection port and the liquid application face 9*a* is reduced as much as possible with the support face of the support member 1 as an inclined face, there may be employed a configuration of providing an inclined face or the like on the ejection element substrate 20 and reducing the distance between the ejection port and the liquid application face 9*a*.

Fourth Embodiment

The present embodiment uses the print head 10 in which both ends of the ejection element substrate 20 in the y-direction are sealed with sealing materials 4*a* and 4*b*, respectively.

The other configuration is the same as that in the first embodiment and explanation thereof will be omitted.

Figure 9:
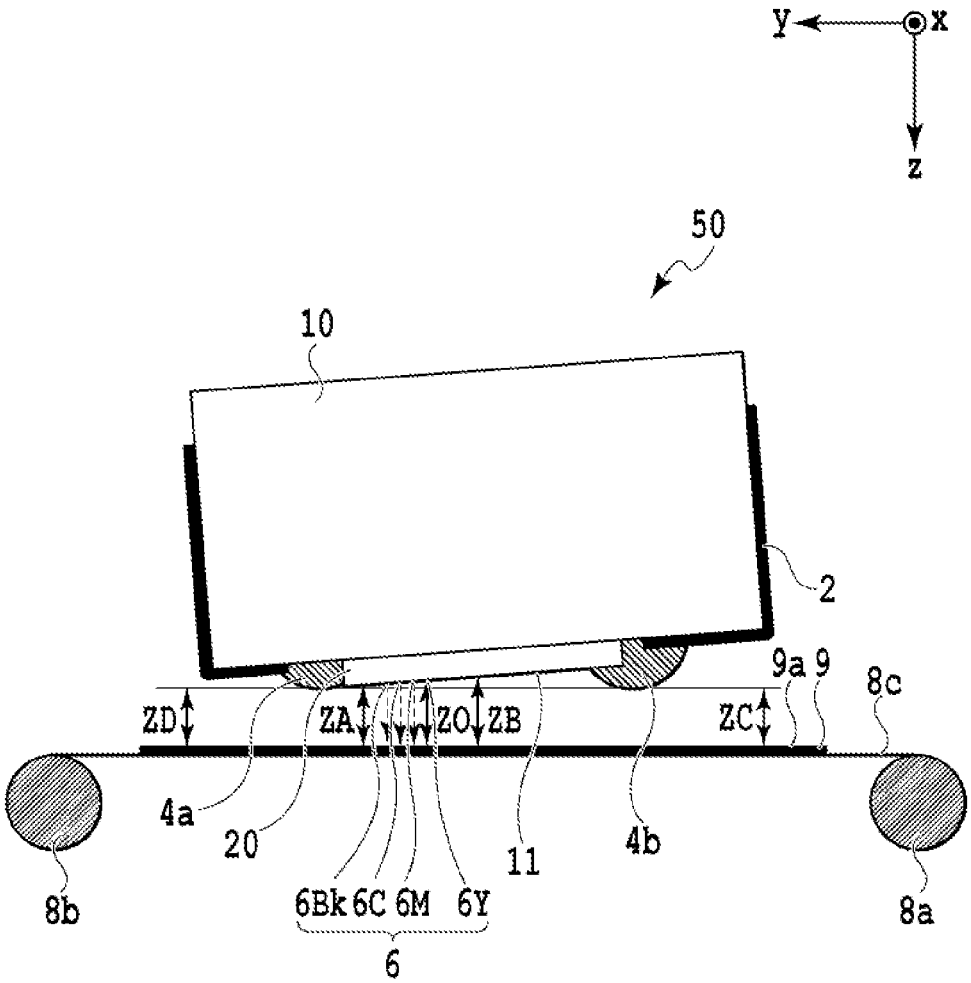
FIG. 9 is a cross-sectional view showing a mounted state of a print head in a fourth embodiment.

FIG. 9 is a cross-sectional view showing a mounted state of the print head 10 on the print apparatus 50 in the present embodiment. While not shown in the drawing, in the present embodiment, the bonding terminals 7 are formed on both end of the ejection element substrate 20 in the y-direction, shown in FIG. 3. Corresponding to these bonding terminals 7, in the print head 10 of the present embodiment, the flexible wiring member 2 on which a plurality of electrical connection pads 5 is formed is disposed also on the side face on the downstream side in the y-direction, shown in FIG. 2. Accordingly, electrical connection portions connecting the bonding terminals 7 and bonding terminals (not shown in the drawing) of the flexible wiring member 2 are provided at both of the end parts in the y-direction, and the sealing materials 4*a* and 4*b* for sealing these electrical connection portions are disposed.

The present embodiment seals the electrical connection part on the upstream side in the y-direction by using the sealing material 4*b*, and seals the electrical connection part on the downstream side in the y-direction by using the sealing material 4*a*.

As shown in FIG. 9, also in the present embodiment, the print head 10 is fixed obliquely to the print apparatus 50 so that the ejection port face 11 has an inclination with respect to the liquid application face 9*a* as in the first embodiment.

Furthermore, as shown in FIG. 9, both ends of the ejection element substrate 20 in the y-direction are sealed with the sealing materials 4*a* and 4*b*, respectively, in the print head 10 used in the present embodiment. There may be cases where a difference is caused between the thicknesses of the sealing materials 4*a* and 4*b* depending on an area difference between the electrical connection portions, a difference in electrical connection method, a kind of sealing material, and the like. In the present embodiment, a case where the thickness of the sealing material 4*b* is larger than that of the sealing material 4*a* will explained.

In the case where the sealing materials having different thicknesses are disposed, the print head is fixed to the print apparatus so that the tip of the sealing material protruding most in the z-direction does not come into contact with the liquid application face and so that the distance between this tip and the liquid application face does not become smaller than the minimum distance. Since the thickness of the sealing material 4*b* is larger than the thickness of the sealing material 4*a*, the print head 10 is fixed to the print apparatus 50 so that the distance ZB between the ejection port face 11 on the sealing material 4*b* side and the liquid application face 9*a* does not become smaller than the distance ZC. The print head 10 is fixed so that the distance ZA between the ejection port face 11 on the sealing material 4*a* side and the liquid application face 9*a* becomes smaller than the distance ZB.

Furthermore, also in the present embodiment, the print head 10 is mounted on the print apparatus 50 so that the distance ZC and the distance ZD becomes approximately the same as each other.

In this way, also in the case where a plurality of sealing materials is disposed, either the tips of the plurality of sealing materials or the ejection port face 11 is not disposed at a position which is closer to the liquid application face 9*a* than the distance ZC, and the distance between the ejection port and the liquid application face 9*a* is reduced as compared with that in the configuration shown in FIG. 4. Thereby, also in the present embodiment, it is possible to prevent the sealing material 4 or the ejection port face 11 from coming into contact with the print medium 9 during the image printing, and also it is possible to suppress the image quality degradation.

Meanwhile, while in the present embodiment, there has been explained the configuration in which both of the sealing materials 4*a* and 4*b* are used for sealing the electrical connection portions, either the sealing material 4*a* or the sealing material 4*b* may be used for the purpose other than the sealing of the electrical connection part. For example, either the sealing material 4*a* or the sealing material 4*b* may be used for preventing damage of the ejection element substrate, or may be used for preventing leakage from the electrical connection part.

Furthermore, in the present embodiment, the case where the sealing materials are disposed at two locations has been explained. However, also in the case where the sealing materials are disposed at two or more locations, by setting the distance between the tip of the sealing material protruding most in the z-direction and the liquid application face to be the minimum distance, and by reducing the distance between the ejection port and the liquid application face as much as possible, it is possible to obtain the same effect as the above.

Fifth Embodiment

In the present embodiment, a plurality of print heads 10 is used. The other configuration is the same as that in the first embodiment and explanation thereof will be omitted.

Figure 10:
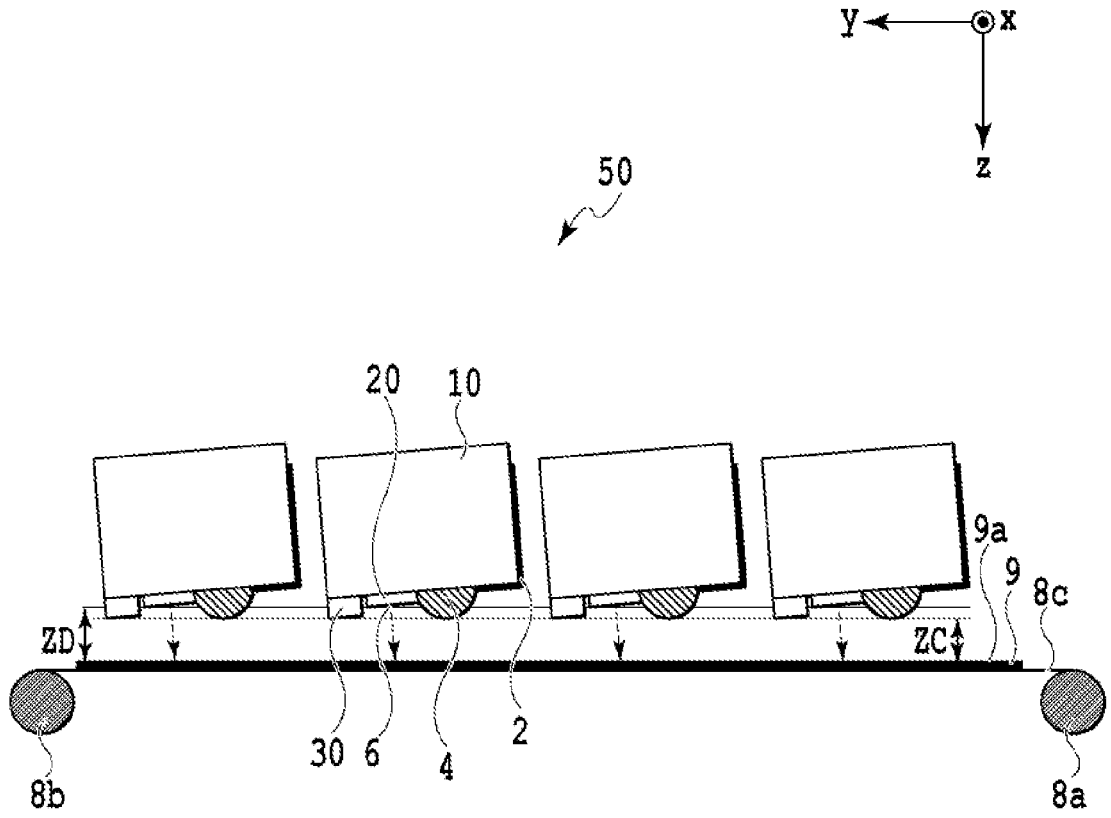
FIG. 10 is a cross-sectional view showing amounted state of a plurality of print heads in a fifth embodiment.

FIG. 10 is a cross-sectional view showing amounted state of the plurality of print heads 10 on the print apparatus 50. As shown in FIG. 10, the four print heads 10 are disposed on the print apparatus 50, along the y-direction.

As shown in FIG. 10, each of the print heads 10 is mounted on the print apparatus 50 in the same way as in the first embodiment. Namely, each of the print heads 10 is mounted on the print apparatus 50 so that the distance between the sealing material 4 and the liquid application face of 9*a* of the print medium 9 is not brought closer to the distance ZC being the minimum distance and so that the distance between the ejection port and the liquid application face 9*a* is brought closer to each other as much as possible. Thereby, also in the case where the plurality of print heads 10 are used and in the case where deformation or the like is caused in the print medium 9, it is possible to prevent the contact with the print medium 9 or the occurrence of jamming and also it is possible to prevent the image quality degradation.

Meanwhile, in addition to the sealing material 4, a member 30 protruding from the ejection port face in the z-direction is disposed on each of the print heads 10 shown in FIG. 10. In the print head 10 shown in FIG. 10, the sealing material 4 protrudes more in the z-direction than the member 30. Accordingly, each of the print heads 10 is mounted on the print apparatus 50 so that the apex of the sealing material 4 does not come into contact with the print medium 9 and so that the distance between the apex and the liquid application face 9*a* does not become smaller than the minimum distance ZC. In addition, each of the print heads 10 is mounted on the print apparatus 50 so that also the distance between the member 30 and the liquid application face 9*a* does not become the distance ZC or less.

In this way, also in the case where the protruding member 30 is provided other than the sealing material 4, by not causing both of the distance between the sealing material 4 and the liquid application face 9*a* and the distance between the member 30 and the liquid application face 9*a* to become the minimum distance ZC or less, it is possible to prevent the jamming occurrence or the like.

Other Embodiments

While, in the above embodiments, there can be explained the case where the print head 10 is constituted with one ejection element substrate 20, the print head 10 may be constituted with a plurality of ejection element substrates. For example, the print head 10 may be constituted by continuously connecting the plurality of ejection element substrates.

Figure 11:
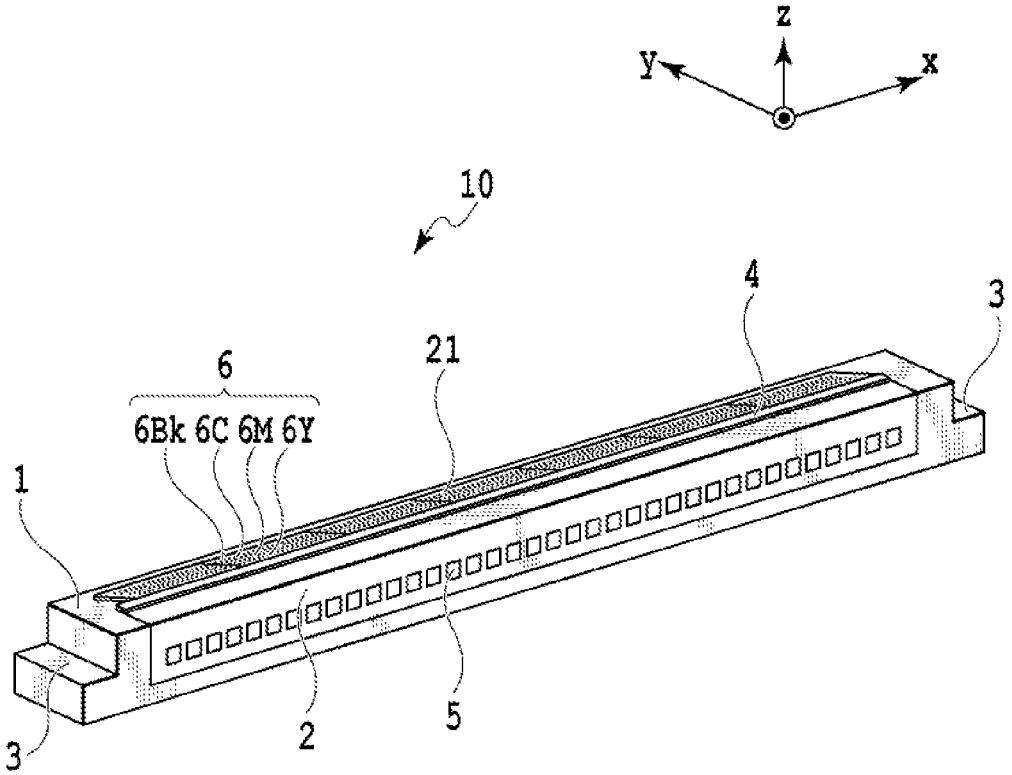
FIG. 11 is a perspective view showing a print head in another embodiment.

FIG. 11 is a perspective view showing the print head 10 constituted with the plurality of ejection element substrates 21. The plurality of ejection element substrates 21 is disposed in the print head 10 shown in FIG. 11, and the print head 10 is constituted by connecting the plurality of ejection element substrates 21. The ejection port array 6 constituted with the plurality of ejection ports and un-illustrated terminals are formed on each of the ejection element substrate 21.

Also in the print head 10 shown in FIG. 11, the electrical connection portion connecting the ejection element substrate 21 and the flexible wiring member 2 is sealed with the sealing material 4. Also in the case where the print head 10 like this is used for the print apparatus 50, it is possible to apply the present invention.

In the above embodiments, there has been explained the print apparatus 50 using the print head 10 in which inks different for each of the four ejection port arrays are ejected and four-color printing is available. However, the print head 10 applicable to the print apparatus 50 is not limited to one having the above configuration. For example, a print head capable of one-color printing may be used. In addition, although in the above embodiments, the print head of a full-line type has been explained, the present invention can be applied also to a serial-type print head.

While, in the above embodiments, there has been explained the case where the part protruding more toward the print medium 9 than the ejection port face 11 is the sealing material 4, the present invention can be applied also to the case where a member other than the sealing material 4 protrudes more toward the print medium 9 than the ejection port face 11. For example, also in the case where a member for leaking static electrical charge, a member for collecting ink mist, and the like are provided on the print head and these members protrude from the ejection port face in the ejection direction, it is possible to obtain the same effect as that of the above embodiments by applying the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-000954, filed Jan. 7, 2014, which is hereby incorporated by reference wherein in its entirety.

What is claimed is:

1. A liquid ejection apparatus which applies liquid to a medium by using a liquid ejection head including an ejection port ejecting the liquid and a member protruding more toward a liquid ejection direction than an ejection port face where the ejection port is formed, wherein a first distance between the ejection port and the medium is smaller than a sum of a second distance from the ejection port face to a tip of the member in the ejection direction and a third distance from the tip to the medium.

2. The liquid ejection apparatus according to claim 1, wherein the ejection port includes a first ejection port and a second ejection port disposed at a position farther from the member than the first ejection port, and a distance between the second ejection port and the medium is smaller than a distance between the first ejection port and the medium.

3. The liquid ejection apparatus according to claim 2, wherein ink is used as the liquid and a color of ink ejected from the first ejection port is lighter than a color of ink ejected from the second ejection port.

4. The liquid ejection apparatus according to claim 1, wherein the liquid ejection head includes an ejection element substrate where the ejection port is formed, and a wiring member electrically connected to the ejection element substrate, and the member protruding more toward the liquid ejection direction than the ejection port face is a sealing material sealing an electrical connection portion connecting the ejection element substrate and the wiring member.

5. The liquid ejection apparatus according to claim 4, wherein the sealing material includes a first sealing material, and a second sealing material protruding more toward the liquid ejection direction than the first sealing material, and the first distance is a distance smaller than a sum of a distance from the ejection port face to a tip of the second sealing material in the liquid ejection direction and a distance from the tip to the medium.

6. The liquid ejection apparatus according to claim 1, wherein the ejection port face and a liquid application face of the medium to which the liquid is applied are relatively inclined.

7. The liquid ejection apparatus according to claim 1, wherein a plurality of the liquid ejection heads is used, and the first distance is set for each of the plurality of the liquid ejection heads.

8. A liquid ejection head, comprising:

an ejection element substrate where an ejection port ejecting liquid is formed; and a support member having a support face supporting the ejection element substrate, wherein the support face is an inclined face supporting the ejection element substrate, with an inclination with respect to a liquid application face of a medium where the liquid ejected from the ejection port is applied, in a posture during use of the liquid ejection head.

9. A liquid ejection apparatus, wherein the liquid ejection head according to claim 8 is used for applying liquid to a medium.

* * * * *